US007026894B2

(12) United States Patent
Tobin et al.

(10) Patent No.: US 7,026,894 B2
(45) Date of Patent: Apr. 11, 2006

(54) METHOD AND APPARATUS FOR MAGNETICALLY TRIPPING CIRCUIT BREAKERS

(75) Inventors: Michael Tobin, Burlington, CT (US); Timothy Gerard Richter, Wynantskill, NY (US); Hemant Mody, Avon, CT (US); Michael Ronzello, Kensington, CT (US); Dean A. Robarge, Southington, CT (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/708,448

(22) Filed: Mar. 4, 2004
(Under 37 CFR 1.47)

(65) Prior Publication Data

US 2004/0251994 A1 Dec. 16, 2004

Related U.S. Application Data

(60) Provisional application No. 60/454,426, filed on Mar. 13, 2003.

(51) Int. Cl.
*H01H 73/00* (2006.01)

(52) U.S. Cl. ..... 335/16; 361/115; 361/93.9

(58) Field of Classification Search ..... 335/6, 335/8–10, 16, 18, 147, 195, 165–176; 218/22; 361/93.9, 96, 115
See application file for complete search history.

(56) References Cited

U.S. PATENT DOCUMENTS 4,884,048 A * 11/1989 Castonguay et al. ..... 335/18
6,054,912 A * 4/2000 Kaneko et al. ..... 335/172
6,480,082 B1 * 11/2002 Aihara et al. ..... 335/202

* cited by examiner

*Primary Examiner*—Lincoln Donovan
(74) *Attorney, Agent, or Firm*—Cantor Colburn LLP

(57) ABSTRACT

An apparatus for interrupting an electrical short circuit current in an electrical distribution system having a plurality of phases is disclosed. The apparatus includes a housing, a plurality of separable conduction paths, an operating mechanism in operable communication with the plurality of conduction paths, an electronic trip unit in signal communication with each of the plurality of conduction paths and in operable communication with the operating mechanism, and an electromagnetic trip unit in signal communication with each of the plurality of conduction paths and in operable communication with the operating mechanism. The electromagnetic trip unit is configured to be operably responsive to a first half-cycle waveform of the short circuit current prior to the electronic trip unit being operably responsive to a second multi-cycle waveform of the short circuit current.

23 Claims, 7 Drawing Sheets

METHOD AND APPARATUS FOR MAGNETICALLY TRIPPING CIRCUIT BREAKERS

CROSS REFERENCE TO RELATED APPLICATIONS

This application claims the benefit of U.S. Provisional Application Ser. No. 60/454,426, filed Mar. 13, 2003, which is incorporated herein by reference in its entirety.

BACKGROUND OF INVENTION

The present disclosure relates generally to an electromagnetic trip unit for a circuit breaker, and particularly to an electromagnetic trip unit for a circuit breaker also equipped with an electronic trip unit.

Circuit breakers are used today in electrical distribution systems for protecting electrical circuits, and may be single-phase or multi-phase devices having a variety of ampere and voltage ratings, such as 15–1200 amps at 120–600 volts ac, for example. To respond to a short circuit condition, circuit breakers employ trip units, which may be thermal, magnetic, pressure actuated, or electronic in nature, and may be coupled to contact arms that are of a blow open or non-blow open arrangement. With blow open contact arm arrangements, a short circuit condition causes the contact arms to blow open independent of the circuit breaker operating mechanism and independent of the trip unit action. The blow open contact arm arrangement provides for a rapid response to a short circuit condition, while the electronic trip unit arrangement provides for a multi-functional tripping device. However, under certain short circuit conditions, the electronic trip unit, due to the magnetic characteristics of the current sensors employed, may be limited in accuracy during high short circuit current conditions. This accuracy limitation may prevent accurate measurement of 12 t (ampere-squared-seconds) and therefore coordination of upstream-downstream circuit breakers. Supplemental trip units, such as magnetic trip systems, have been added to the center pole of electronic circuit breakers to allow the breaker's trip system as a whole to respond to the fast transients or high rate of current change (di/dt) in high-available three-phase faults. These modifications have been done to speed up the mechanism trip timing, but may not allow coordination between devices for three phase or single phase faults. With the addition of a supplemental trip unit, the limitation of the electronic trip unit's CT's is compensated under high fault conditions. In addition to providing a trip system that can react to a fast system current transient, the supplemental trip unit can be designed to allow a set amount of 12 t to go through the circuit breaker prior to its tripping. An advantage to setting this 12 t is that the breaker can be designed not to trip when a downstream device is capable of and in the process of clearing a circuit. Allowing downstream breakers to clear before upstream breakers is known as coordination. The limitations in coordination of some earlier generation circuit breakers have been in the long-time to short-time region of the breaker's Trip Current Curve, with coordination being provided primarily under three-phase overload conditions. In more recently developed breakers, three-phase coordination has evolved to the entire range of available currents, including instantaneous response, by implementing supplemental trip systems using pressure trips. However, pressure trip systems create a trip response by utilizing arc chamber gas, which is extremely conductive and may place a dielectric stress on associated parts during and after a short circuit. Magnetic systems which have utilized a single pole magnet in the center pole to speed mechanism trip times, may enable some level of coordination in high fault conditions, but may not enable complete protection for lower fault conditions on all poles. Specifically, a magnet on the center pole may provide suitable protection in response to a high fault condition occurring on the center pole for either single phase or three phase faults. However, for a single phase fault condition occurring on an outer pole, the center pole supplemental trip system may be ineffective for tripping the circuit breaker operating mechanism. Additionally, on three phase faults, if the maximum asymmetrical current offset exists on an outer pole with a minor loop occurring on the center pole, the supplemental trip system may not be able to respond as rapidly as desired.

To advance the field of short circuit interruption technology, it would be advantageous to have a circuit breaker with a multi-functional electronic trip unit that can more rapidly respond to the onset of a short circuit fault condition and coordinate with downstream interruption devices under both three-phase and single-phase fault conditions.

SUMMARY OF INVENTION

Embodiments of the invention include an apparatus for interrupting an electrical short circuit current in an electrical distribution system having a plurality of phases. The apparatus includes a housing, a plurality of separable conduction paths, an operating mechanism in operable communication with the plurality of conduction paths, an electronic trip unit in signal communication with each of the plurality of conduction paths and in operable communication with the operating mechanism, and an electromagnetic trip unit in signal communication with each of the plurality of conduction paths and in operable communication with the operating mechanism. The electromagnetic trip unit is configured to be operably responsive to a first half-cycle waveform of the short circuit current prior to the electronic trip unit being operably responsive to a second multi-cycle waveform of the short circuit current.

Additional embodiments of the invention include an electronic circuit breaker having a plurality of separable conduction paths and an operating mechanism in operable communication with the plurality of conduction paths. The circuit breaker includes an electronic trip unit in signal communication with each of the plurality of conduction paths and in operable communication with the operating mechanism, and an electromagnetic trip unit in signal communication with each of the plurality of conduction paths and in operable communication with the operating mechanism. The electromagnetic trip unit is configured to be operably responsive to a first half-cycle waveform of the short circuit current prior to the electronic trip unit being operably responsive to a second multi-cycle waveform of the short circuit current.

Further embodiments of the invention disclose a method of interrupting an electrical short circuit current in an electrical distribution system having a plurality of phases. The electrical short circuit current is sensed at an electronic trip unit in signal communication with each of a plurality of conduction paths and in operable communication with an operating mechanism. The electrical short circuit current is also sensed at an electromagnetic trip unit in signal communication with each of the plurality of conduction paths and in operable communication with the operating mechanism. In response to a first half-cycle waveform of the electrical short circuit at the electromagnetic trip unit, a circuit breaker is tripped to interrupt the electrical short circuit current therethrough. The electromagnetic trip unit is configured to be operably responsive to the first half-cycle waveform of the short circuit current prior to the electronic trip unit being operably responsive to a second multi-cycle waveform of the short circuit current.

BRIEF DESCRIPTION OF DRAWINGS

Referring to the exemplary drawings wherein like elements are numbered alike in the accompanying Figures.

DETAILED DESCRIPTION

An embodiment of the invention provides a rotary circuit breaker having a cassette construction with coordinated electronic and electromagnetic trip units for selective tripping of a specific circuit breaker in a series of circuit breakers. While embodiments described herein depict an electronic trip unit having a current transformer as an exemplary current sensor, it will be appreciated that the disclosed invention is also applicable to other current sensors, such as Hall Effect current sensors for example. Furthermore, while embodiments described herein depict an electromagnetic trip unit having a magnetic yoke and magnetic armature as an exemplary magnetic actuator, it will be appreciated that the disclosed invention is also applicable to other magnetic actuators, such as a solenoid for example. Yet further, while the disclosed embodiments depict a blow open rotary contact arm structure in a cassette housing, it will be appreciated that the disclosed invention is also applicable to non-blow open contact arm structures and single break contact arm structures in non-cassette molded housings.

In an exemplary embodiment, a circuit breaker, having an outer housing and an operating mechanism with a trip latch, includes an electronic trip unit and an electromagnetic trip unit. The electronic trip unit includes a current sensor and is in operable communication with the operating mechanism. The electromagnetic trip unit is also in operable communication with the operating mechanism and includes a magnetic armature. At least one pole per phase is in operable communication with the operating mechanism, the magnetic armature, and the current sensor. Each pole includes a conduction path having a rotary contact bridge with a pair of separable contacts at each end or a single contact arm with a single set of contacts. The conduction path has a first portion in signal communication with the current sensor and a second portion that is partially surrounded by and in signal communication with a magnetic yoke. The magnetic yoke is in operable communication with the magnetic armature. The electromagnetic trip unit, which forms the supplemental trip unit, and the electronic trip unit, are responsive to the same current waveform but react to different predefined thresholds.

Figure 1:
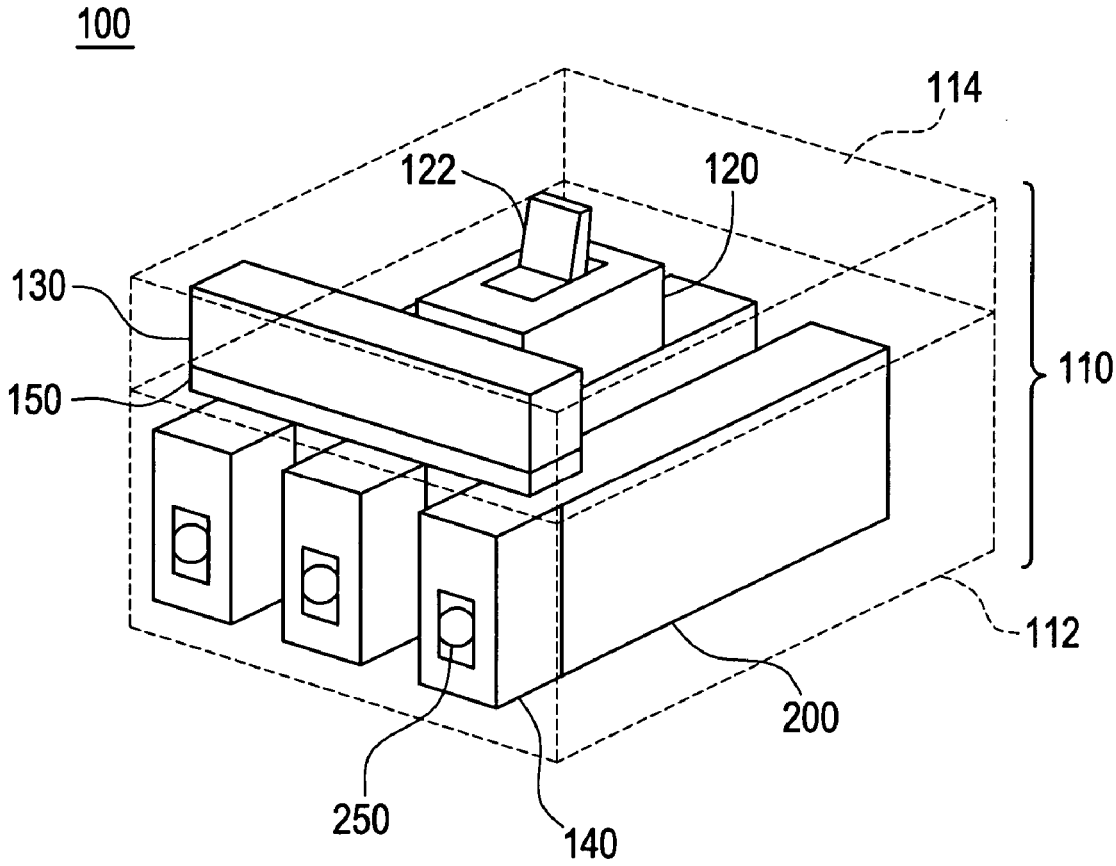
FIG. 1 is an isometric view of a circuit breaker for implementing an embodiment of the invention.

FIG. 1 is an exemplary embodiment of a three-phase circuit breaker 100 having three cassettes 200, with each phase having one cassette 200. Alternative multi-phase circuit breakers may employ more than one cassette per phase depending on the modularity of construction employed. For example, high ampere rated devices may employ two cassettes per phase, with each cassette carrying only half of the current in that phase, the current-carrying characteristics of cassette 200 being described below. While an embodiment of the invention is depicted in reference to a three-phase circuit breaker 100, the artisan will appreciate that the invention is also applicable to circuit breakers other than three-phase, such as two-phase and four-phase (switching neutral), for example. FIG. 1 also depicts circuit breaker 100 having: a housing 110 with base 112 and cover 114 (shown in phantom); an operating mechanism 120 having an operating handle 122 and a link assembly 124 (discussed in reference to FIG. 2); an electronic trip unit 130 having current sensors 140, such as current transformers (CT's) for example; and, an electromagnetic trip unit 150. Link assembly 124 provides the mechanical interface between operating mechanism 120 and a rotary contact bridge 215, discussed below in reference to FIG. 2, and electromagnetic trip unit 150 provides a means for tripping operating mechanism 120 independent of electronic trip unit 130 in response to an inrush current, discussed below in reference to FIG. 8.

Figure 2:
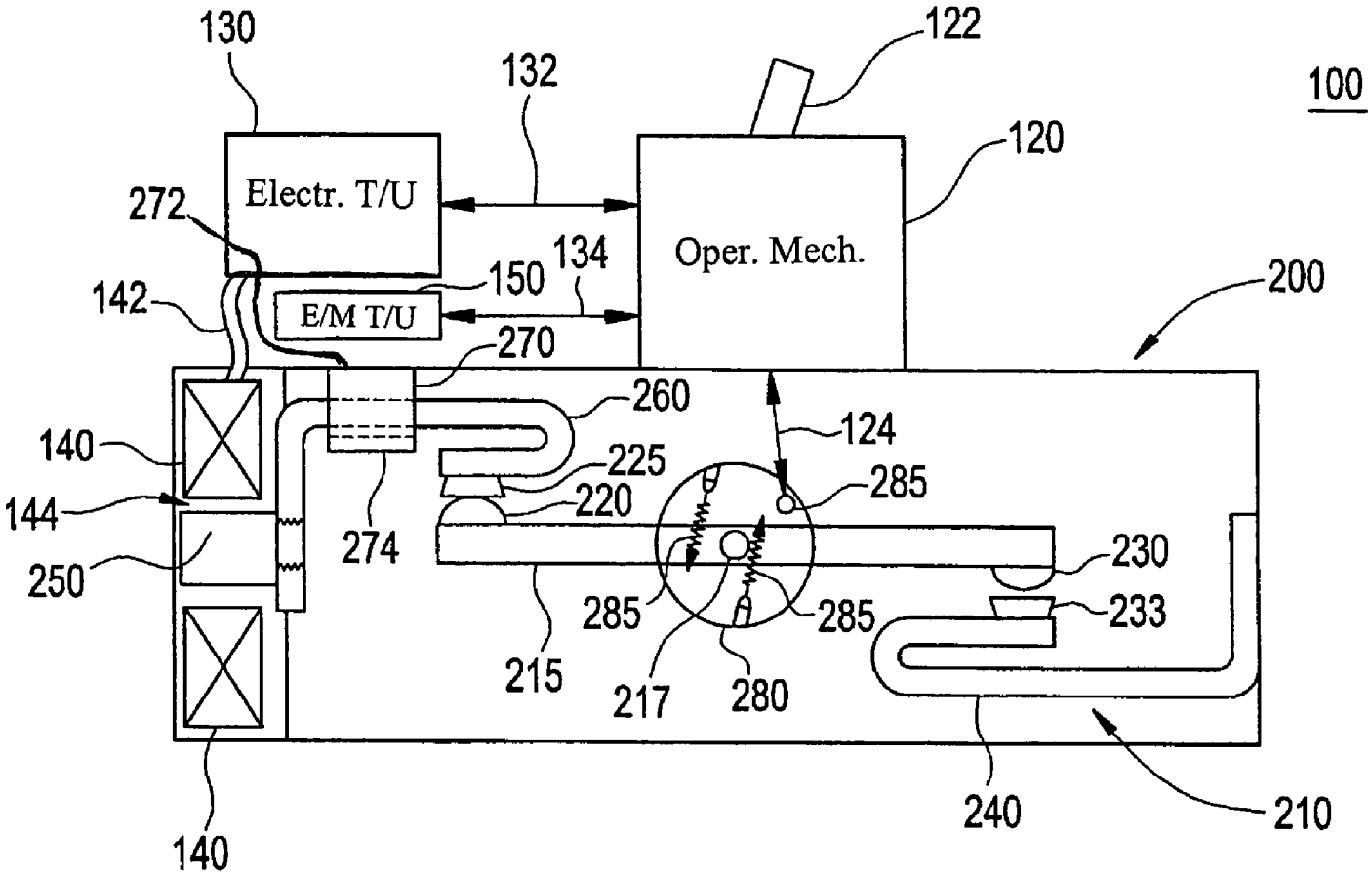
FIG. 2 is a side view of the circuit breaker of FIG. 1 with detail removed for clarity.

Referring now to FIG. 2, electronic trip unit 130 is in signal communication with CT 140 via signal wires 142 and is in operable communication with operating mechanism 120 via signal path 132. In an embodiment, each cassette 200 includes a conduction path 210 having: rotary contact bridge 215 with a pair of separable contacts 220, 225 and 230, 235 at each end of contact bridge 215, thereby defining a double-break contact structure; a first conductor 240 for connecting circuit breaker 100 to a line connection of a protected electrical circuit (not shown); a second conductor 250 for connecting circuit breaker 100 to a load connection of the protected electrical circuit and for magnetically coupling conduction path 210 to CT 140 at window 144 of CT 140; and, a third conductor 260 interposed between rotary contact bridge 215 and second conductor 250 for magnetically coupling, via a magnetic yoke 270, conduction path 210 to electromagnetic trip unit 150. Electromagnetic trip unit 150 is in operable communication with mechanism 120 via signal path 134, which is discussed below in reference to FIGS. 4–5. Magnetic yoke 270 is a generally U-shaped ferromagnetic member that partially surrounds third conductor 260, with its open end terminating in pole faces 272 for directing a magnetic flux to a magnetic armature 152, best seen by now referring to FIG. 3, and its closed end 274 wrapping around third conductor 260. In an alternative embodiment, magnetic yoke 270 is insulated from third conductor 260 to reduce electric current flow through and resistive heating of magnetic yoke 270. Link assembly 124 interfaces with rotary contact bridge 215 via a rotor 280 and interconnecting contact springs 285. Contact springs 285 provide a means for generating a contact force at contact pairs 220, 225 and 230, 235 and provide a means for contact bridge 215 to blow open during a short circuit inrush. The reverse loop configuration of first and third conductors 240, 260 further accentuate the blow open action of rotary contact bridge 215 during a short circuit current condition.

Figure 3:
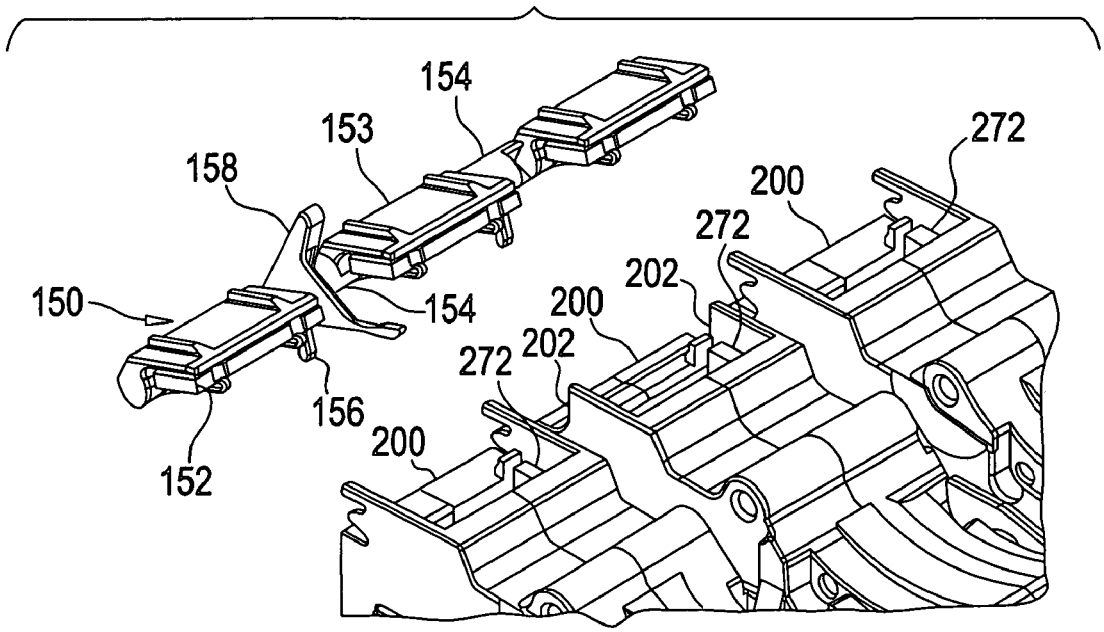
FIG. 3 is an isometric view of an electromagnetic trip unit in accordance with an embodiment of the invention.
Figure 4:
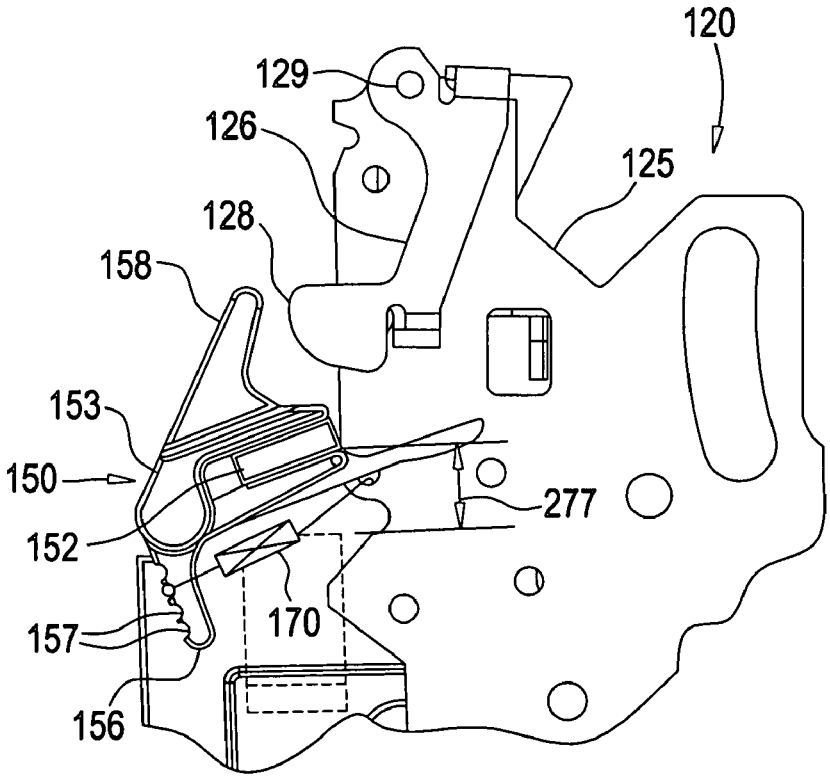
FIG. 4 is a side view of the electromagnetic trip unit of FIG. 3 in the open position.

FIG. 3 depicts electromagnetic trip unit 150 in relation to cassettes 200, where electromagnetic trip unit 150 includes a trip bar 153 having pivot bearings 154 that pivotally engage with cassettes 200 at pivot guides 202. Trip bar 153, which is typically made of a plastic insulative material, captivates magnetic armature 152 by any suitable means, such as snap fit, fastener, or adhesive for example. In an embodiment, each phase (pole) of circuit breaker 100 has a magnetic armature 152. A spring anchor 156 on electromagnetic trip unit 150 provides an attachment point for bias spring 170, best seen by now referring to FIG. 4, that extends between spring anchor 156 and mechanism frame 125 of operating mechanism 120, thereby biasing electromagnetic trip unit 150 in a counterclockwise direction (as viewed from FIG. 4) and against pivot guides 202 (as viewed from FIG. 3). Bias spring 170 may be attached at one of several notches 157 on spring anchor 156, thereby enabling bias force adjustment of trip bar 153. A trip arm 158 on electromagnetic trip unit 150 provides a means of engaging electromagnetic trip unit 150 with operating mechanism 120 via trip latch 126. Trip latch 126 includes a trip lobe 128 that receives trip arm 158 during a trip action from electromagnetic trip unit 150, which results in trip latch 126 rotating counterclockwise about pivot 129. The rotation of trip latch 126 serves to unlatch operating mechanism 120 in any manner to trip operating mechanism 120 thereby resulting in the opening of contact bridge 215 about pivot 217 via link assembly 124, rotor 280, and drive pin 285. FIG. 4 depicts trip latch 126, and therefore operating mechanism 120, in the latched position and electromagnetic trip unit 150 in the non-actuated (quiescent) position. One pole face 272 of each electromagnetic yoke 270, one per phase, is partially shown at cassette 200 in FIG. 3.

Figure 5:
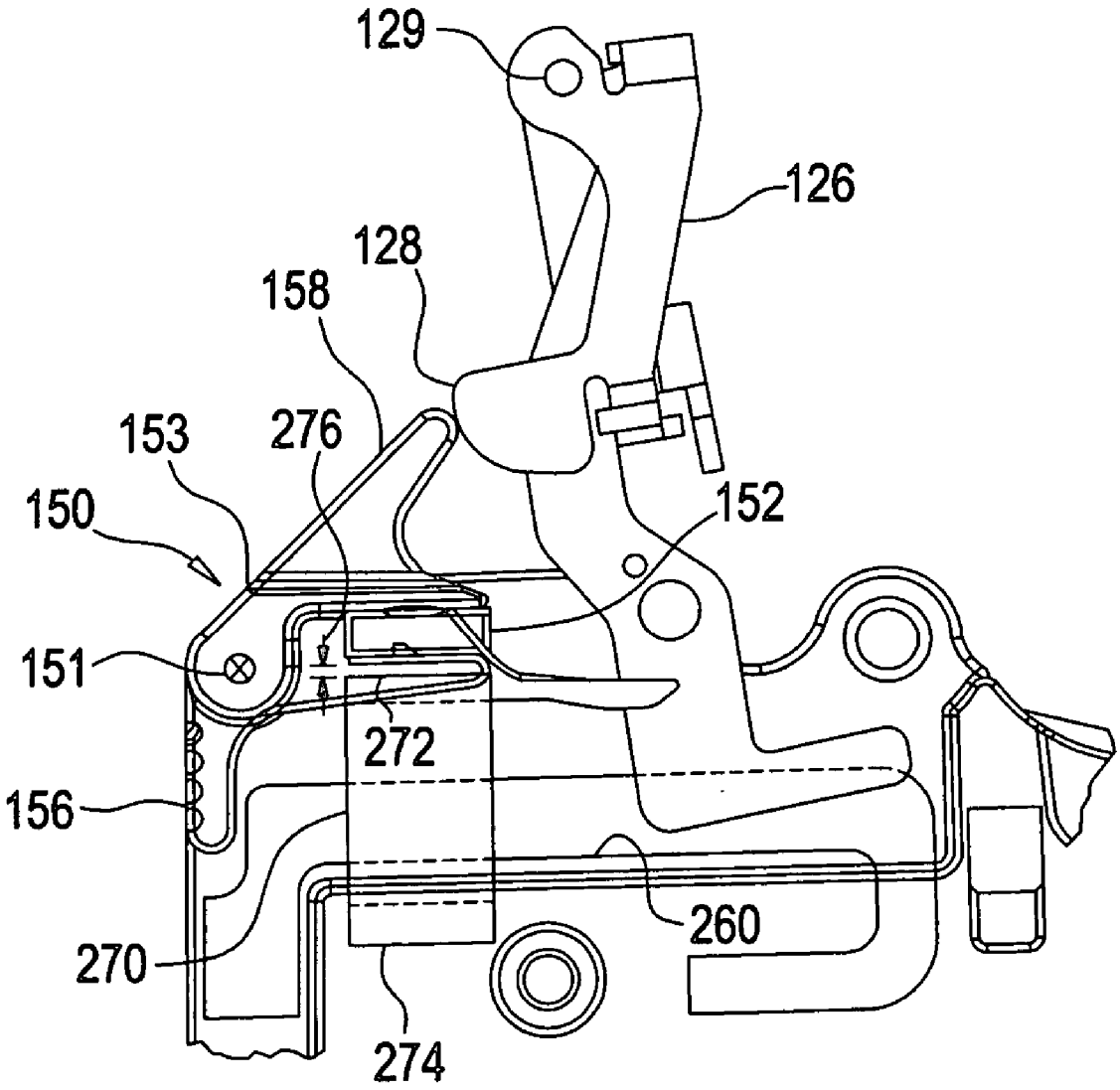
FIG. 5 is a side view of the electromagnetic trip unit of FIG. 3 in the closed position.

Referring now to FIG. 5, electromagnetic trip unit 150 is depicted in the actuated (operational) position, having been rotated clockwise about pivot 151, which results in the counterclockwise rotation of trip latch 126 about pivot 129 and the tripping of operating mechanism 120, as discussed above. The close proximity of magnetic armature 152 to pole faces 272 of magnetic yoke 270, separated by air gap 276, results when electromagnetic trip unit 150 is in the actuated (closed) position. As discussed above, U-shaped magnetic yoke 270 partially surrounds third conductor 260, with the open end (pole faces 272) arranged proximate magnetic armature 152 on one side of third conductor 260, and the closed end 274 on the opposing side of third conductor 260.

Figure 6:
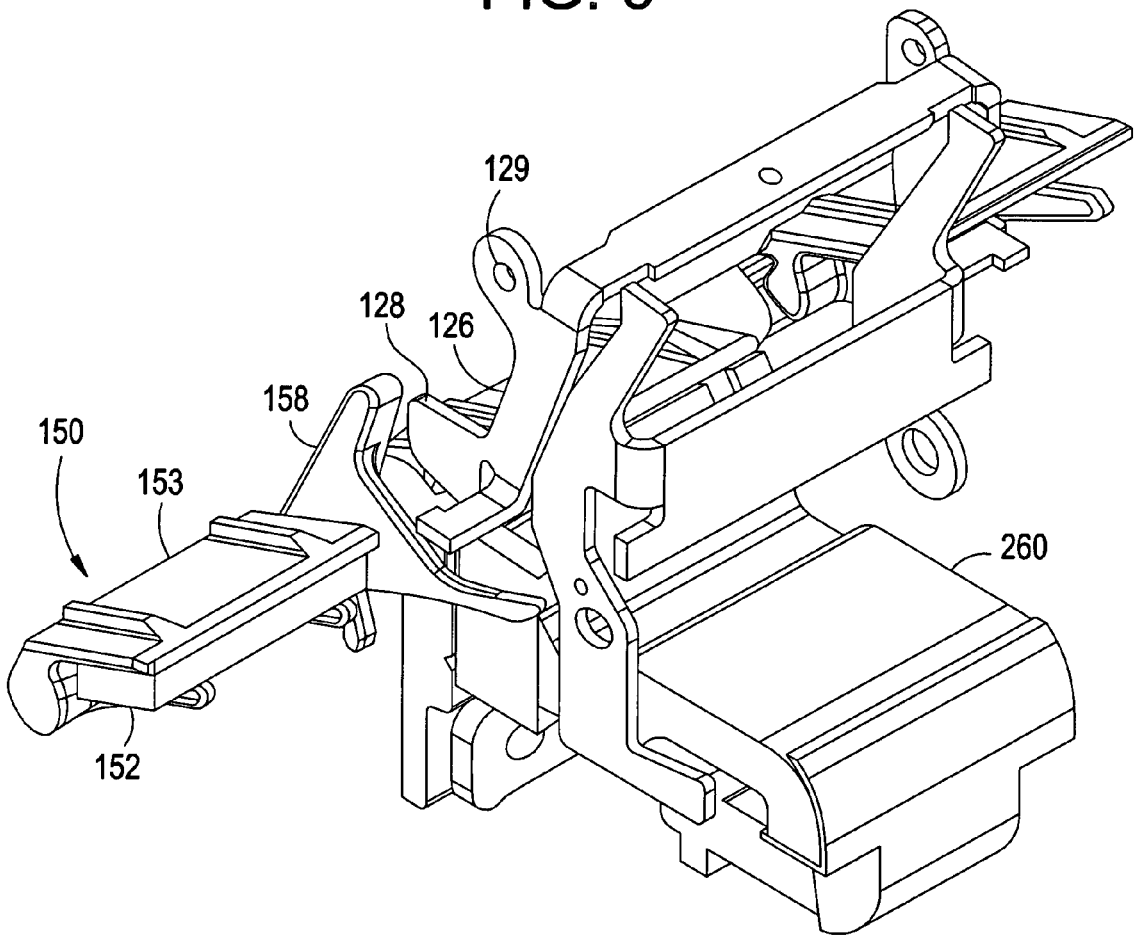
FIG. 6 is an isometric view of the electromagnetic trip unit of FIG. 3 in relation to a latched operating mechanism of the circuit breaker of FIG. 1.
Figure 7:
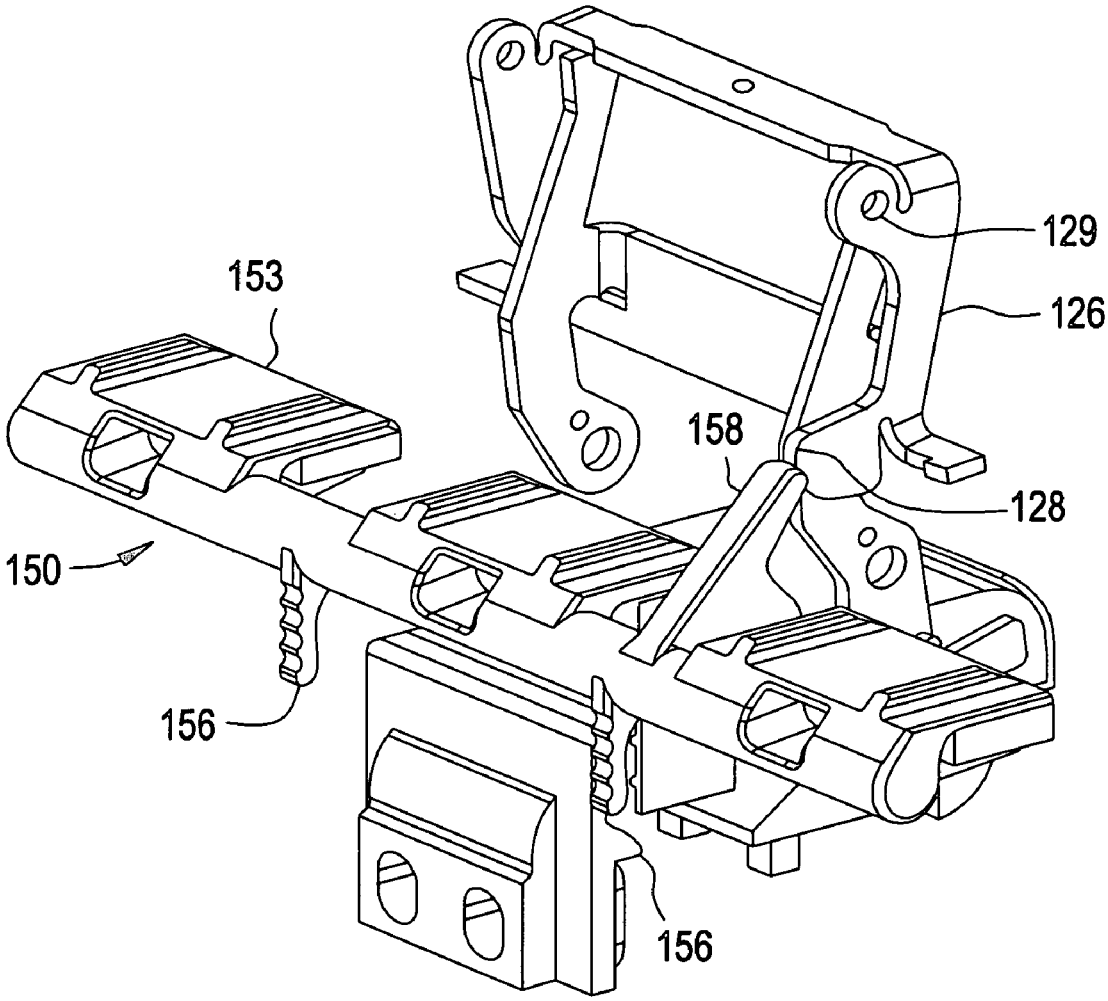
FIG. 7 is an alternative view to that of FIG. 6 with the operating mechanism in an unlatched position.

FIG. 6 depicts an alternative isometric view of electromagnetic trip unit 150 in the non-actuated position and trip latch 126 in the latched position (similar to FIG. 4), and FIG. 7 depicts an alternative isometric view of electromagnetic trip unit 150 in the actuated position and trip latch 126 in the tripped position (similar to FIG. 5).

Figure 8:
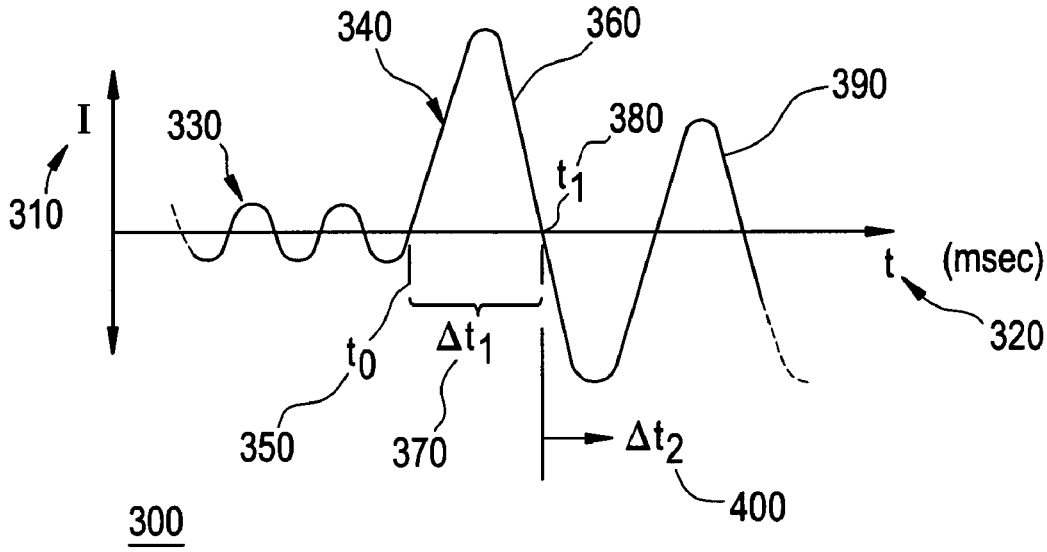
FIG. 8 is a graphical representation of a current waveform experienced by the circuit breaker of FIG. 1.

FIG. 8 depicts a graphical representation 300 of a phase current (I) 310 in amperes (amps) as a function of time (t) 320 in milliseconds (msec) for a quiescent current flow 330 and an asymmetrical short circuit current flow 340 beginning at time t0 350. Short circuit current flow 340 has a first half cycle waveform 360 beginning at 350 and extending over a time interval of delta-t1 370 that ends at time t1 380, and a second multi-cycle waveform 390 beginning at 380 and extending over a time interval of delta-t2 400 that ends at a time determined by system parameters and performance.

The operation of electromagnetic trip unit 150 in relation to the waveform of FIG. 8 will now be described. During quiescent operation of circuit breaker 100, quiescent current 330 flows through circuit breaker 100 via first conductor 240, separable contacts 235, 230, rotary contact bridge 215, separable contacts 220, 225, third conductor 260, and second conductor 250. First and second conductors 240, 250 are connected to the protected electrical circuit (not shown) by any means suitable for purposes disclosed herein. The ON-OFF operation of circuit breaker 100 is accomplished by a user actuating operating mechanism 120 via operating handle 122 to open and close separable contact pairs 220, 225 and 230, 235. Operating mechanism 120 drives link assembly 124, which is connected to rotor 280 via drive pin 285, to rotate rotary contact bridge 215 about pivot 217. Operating mechanism 120 is of any type suitable for operating circuit breakers.

The occurrence of a short circuit current flow 340, as depicted in FIG. 8, through circuit breaker 100 results in a coordinated response between electronic trip unit 130, electromagnetic trip unit 150, and rotary contact bridge 215. Due to the saturation and hysteresis characteristics of current transformer 140, electronic trip unit may not accurately represent the true current value of first half cycle waveform 360 of short circuit current 340, and therefore may not respond by sending a trip signal to operating mechanism 120 during the time interval of delta-t1 370. While electronic trip unit 130 would accurately represent the true current value of second multi-cycle waveform 390 of short circuit current 340, and respond by sending a trip signal to operating mechanism 120 in response thereof, it is desirable to have a trip signal sent to operating mechanism between time t0 350 and t1 380 since rotary contact bridge 215 is designed to blow open during this first half cycle current waveform 360. Accordingly, electromagnetic trip unit 150 is configured, in a manner described below, to be responsive to the current value of first half cycle waveform 360 of short circuit current 340, and in response thereof to send a trip signal to operating mechanism 120 during the time interval of delta-t1 370. A trip signal communicated to operating mechanism 120 during time interval delta-t1 370 would provide proper coordination between the blow open action of rotary contact bridge 215 and the trip action and indication of operating mechanism 120. If a trip signal were not to be communicated to operating mechanism 120 during the time interval of delta-t1 370 and rotary contact bridge 215 were to successfully blow open and interrupt the flow of short circuit current 340, then an interrupt condition would exist at circuit breaker 100 but a trip condition would not exist at operating mechanism 120, which is undesirable.

As discussed above, electromagnetic trip unit 150 includes magnetic armature 152 that is magnetically coupled to magnetic yoke 270 via air gap 276, 277. Air gap 276, 277 is depicted at 276 in FIG. 5 in the actuated position (closed), and at 277 in FIG. 4 in the non-actuated position (open). Magnetic armature 152, being captivated by trip bar 153, is biased in a counterclockwise direction about pivot 151 (as viewed from FIGS. 4–5) via bias spring 170. The magnetic circuit associated with magnetic armature 152, magnetic yoke 270 and air gap 276, 277, along with the bias force of bias spring 170, via spring 170 design and notch 157 selection, are designed such that electromagnetic trip unit 150 is not responsive to quiescent current flow 330, but is responsive to the current value of first half cycle waveform 360, thereby resulting in a trip signal being sent to operating mechanism during the time interval of delta-t1 370. In this manner, a properly coordinated trip signal is sent to operating mechanism 120 during first half cycle waveform 360. Accordingly, and in reference to first half cycle waveform 360, electromagnetic trip unit 150 is responsive to and electronic trip unit is not responsive to a predefined threshold of the current waveform.

While electromagnetic trip unit 150 is depicted having a single trip bar 153 that is common to all three phases of circuit breaker 100, with each phase having its own set of magnetic armatures 152 and magnetic yokes 270, it will be appreciated that each phase of circuit breaker 100 may also be equipped with its own trip bar 153 and magnetic armature 152, thereby enabling independent single phase operation of electromagnetic trip unit 150 for more selective single phase fault performance. In the event of a selective single phase configuration, it is preferable that each magnetic armature 152 be independently coupled to a magnetic yoke 270 in each phase, and that each magnetic armature be independently coupled to trip latch 126 by any means suitable for single phase tripping in the absence of a common trip bar.

In an embodiment, electronic trip 130 is set to trip at a lower trip threshold than is electromagnetic trip unit 150, and is adjustable through an established range, such as 3× (3 times rated current) to 10× for example. For a high magnitude short circuit current, CT 140 cannot quickly respond due in part to power-up requirements of the electronics and in part to the saturation of the CT core at high currents and di/dt. During this time of power-up and/or saturation, if the trip threshold of electromagnetic trip unit 150 is exceeded magnetic armature 152 will start to move to trip circuit breaker 100. If the short circuit current 340 is sustained, magnetic armature 152 will complete its travel to trip circuit breaker 100 and clear the circuit's short circuit current 340. If a downstream circuit breaker (not shown) clears the circuit before magnetic armature 152 trips the breaker, the magnetic force applied to magnetic armature 152 will go to zero and magnetic armature 152 will return, via bias spring 170, to its initial resting position without tripping circuit breaker 100. The torque or force profile applied to magnetic armature 152 is set by the design of bias spring 170 for a torsion spring, or by the design of bias spring 170 and the selection of moment arm (as a function of position) of the applied spring force, via notches 157. In an embodiment, electromagnetic trip unit 150 is configured to respond in accordance with two constraints: electromagnetic trip unit 150 must be slow enough to avoid tripping circuit breaker 100 when a selected type of down-stream breaker (not shown) is clearing the circuit; and, electromagnetic trip unit 150 must be fast enough to actuate trip latch 126 so that circuit breaker 100 can clear the circuit when there is no downstream circuit breaker.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

The invention claimed is:

1. An apparatus for interrupting an electrical short circuit current in an electrical distribution system having a plurality of phases, the apparatus comprising:

a housing;

a plurality of separable conduction paths;

an operating mechanism in operable communication with the plurality of conduction paths;

an electronic trip unit in signal communication with each of the plurality of conduction paths and in operable communication with the operating mechanism; and an electromagnetic trip unit in electromagnetic field communication with each of the plurality of conduction paths and in operable communication with the operating mechanism;

wherein the electromagnetic trip unit is configured to be operably responsive to a first half-cycle waveform of the short circuit current prior to the electronic trip unit being operably responsive to a subsequent second multi-cycle waveform of the short circuit current, each of the electromagnetic trip unit and the electronic trip unit being operably responsive by being capable of sending a trip signal to the operating mechanism in response to the first half-cycle waveform and the second multi-cycle waveform, respectively.

2. The apparatus of claim 1, wherein:

the electromagnetic trip unit comprises a magnetic actuator disposed at, and in signal communication with, each of the plurality of conduction paths such that each. magnetic actuator is individually in operable communication with the operating mechanism.

3. The apparatus of claim 2, wherein:

the electronic trip unit comprises a current sensor disposed at, and in signal communication with, each of the plurality of conduction paths.

4. The apparatus of claim 3, wherein:

the current sensor comprises a current transformer.

5. The apparatus of claim 2, wherein:

the electromagnetic trip unit comprises a magnetic yoke and a magnetic armature.

6. The apparatus of claim 1, wherein:

the plurality of conduction paths comprises a double-break contact structure.

7. The apparatus of claim 1, wherein:

the plurality of conduction paths comprises a blow open contact arm structure.

8. The apparatus of claim 7, wherein:

the blow open contact arm structure is configured to be operably responsive to the first half-cycle waveform of the short circuit current.

9. The apparatus of claim 8, wherein:

the blow open contact arm structure comprises a rotary contact bridge.

10. The apparatus of claim 1, wherein:

the plurality of conduction paths comprises a conduction path in each of three phases within the housing.

11. The apparatus of claim 10, wherein:

the electromagnetic trip unit comprises a single trip bar that is common to all of the three phases within the housing, each phase of the trip bar having a separate magnetic armature disposed thereat.

12. The apparatus of claim 1, wherein:

the electronic trip unit is configured to trip the operating mechanism at a lower trip threshold than the electromagnetic trip unit is configured to trip the operating mechanism.

13. A method of interrupting an electrical short circuit current in an electrical distribution system having a plurality of phases, comprising:

sensing the electrical short circuit current at an electronic trip unit in signal communication with each of a plurality of conduction paths and in operable communication with an operating mechanism;

sensing the electrical short circuit current at an electromagnetic trip unit in electromagnetic field communication with each of the plurality of conduction paths and in operable communication with the operating mechanism;

in response to a first half-cycle waveform of the electrical short circuit at the electromagnetic trip unit, tripping a circuit breaker to interrupt the electrical short circuit current therethrough;

wherein the electromagnetic trip unit is configured to be operably responsive to the first half-cycle waveform of the short circuit current prior to the electronic trip unit being operably responsive to a subsequent second multi-cycle waveform of the short circuit current, each of the electromagnetic trip unit and the electronic trip unit being operably responsive by being capable of sending a trip signal to the operating mechanism in response to the first half-cycle waveform and the second multi-cycle waveform, respectively.

14. The method of claim 13, wherein the tripping a circuit breaker comprises tripping an operating mechanism in operable communication with a plurality of separable conduction paths.

15. The method of claim 13, wherein the tripping a circuit breaker comprises:

tripping a magnetic actuator disposed at, and in signal communication with, each of the plurality of conduction paths such that each magnetic actuator is individually in operable communication with the operating mechanism.

16. The method of claim 13, further comprising:

blowing open a contact arm structure of the plurality of conduction paths in response to the first half-cycle waveform of the short circuit current.

17. The method of claim 13, wherein the electronic trip unit is configured to trip the operating mechanism at a lower trip threshold than the electromagnetic trip unit is configured to trip the operating mechanism.

18. An electronic circuit breaker having a plurality of separable conduction paths and an operating mechanism in operable communication with the plurality of conduction paths, the circuit breaker comprising:

an electronic trip unit in signal communication with each of the plurality of conduction paths and in operable communication with the operating mechanism; and an electromagnetic trip unit in electromagnetic field communication with each of the plurality of conduction paths and in operable communication with the operating mechanism;

wherein the electromagnetic trip unit is configured to be operably responsive to a first half-cycle waveform of the short circuit current prior to the electronic trip unit being operably responsive to a subsequent second multi-cycle waveform of the short circuit current, each of the electromagnetic trip unit and the electronic trip unit being operably responsive by being capable of sending a trip signal to the operating mechanism in response to the first half-cycle waveform and the second multi-cycle waveform, respectively.

19. The circuit breaker of claim 18, wherein:

the electromagnetic trip unit comprises a magnetic actuator disposed at, and in signal communication with, each of the plurality of conduction paths such that each magnetic actuator is individually in operable communication with the operating mechanism; and the electronic trip unit comprises a current sensor disposed at, and in signal communication with, each of the plurality of conduction paths.

20. The circuit breaker of claim 19, wherein:

the current sensor comprises a current transformer; and the electromagnetic trip unit comprises a magnetic yoke and a magnetic armature.

21. The circuit breaker of claim 18, wherein:

the electronic trip unit is configured to trip the operating mechanism at a lower trip threshold than the electromagnetic trip unit is configured to trip the operating mechanism.

22. The circuit breaker of claim 18, wherein:

the plurality of conduction paths comprises a double-break blow open contact arm structure; and the blow open contact arm structure is configured to be operably responsive to the first half-cycle waveform of the short circuit current.

23. The circuit breaker of claim 21, wherein:

the circuit breaker comprises at least a two-pole circuit breaker, and the electromagnetic trip unit comprises a single trip bar common to all phases wherein each phase of the trip bar has a separate magnetic armature disposed thereat.

* * * * *

UNITED STATES PATENT AND TRADEMARK OFFICE

CERTIFICATE OF CORRECTION

PATENT NO. : 7,026,894 B2
APPLICATION NO. : 10/708448
DATED : April 11, 2006
INVENTOR(S) : Michael Tobin et al.

It is certified that error appears in the above-identified patent and that said Letters Patent is hereby corrected as shown below:

In the Figures,
Figure 2, below reference Numeral "124", delete "285" and insert therefor --286--.

Column 5,
Line 28, after "drive pin", delete "285" and insert therefor --286--.

Column 6,
Line 11, before "to", delete "285" and insert therefor --286--.

Column 7,
Line 67, after "referenced" delete "item" and insert therefor --items--.

Signed and Sealed this

Fourteenth Day of November, 2006

JON W. DUDAS
*Director of the United States Patent and Trademark Office*